US006367801B1

(12) United States Patent
Spencer

(10) Patent No.: US 6,367,801 B1
(45) Date of Patent: Apr. 9, 2002

(54) COIN DROPPING GAME SYSTEM

(76) Inventor: Wayne Spencer, 16010 Hampton Village Dr., Tampa, FL (US) 33618

( * ) Notice: Subject to any disclaimer, the term of this patent is extended or adjusted under 35 U.S.C. 154(b) by 0 days.

(21) Appl. No.: 09/685,230

(22) Filed: Oct. 10, 2000

(51) Int. Cl.[7] ..... A63F 9/00
(52) U.S. Cl. ..... 273/457
(58) Field of Search ..... 273/457, 138.5, 273/447, 412

(56) References Cited

U.S. PATENT DOCUMENTS

| | | | | | |
|---|---|---|---|---|---|
| 2,482,893 | A | * | 9/1949 | Bawden | 273/457 X |
| 2,719,041 | A | * | 9/1955 | Stefanelli et al. | 273/457 X |
| 2,746,757 | A | * | 5/1956 | Frost | 273/457 X |
| 4,177,986 | A | * | 12/1979 | Campbell | 273/447 |
| 5,282,636 | A | * | 2/1994 | Wyman et al. | 273/457 |

* cited by examiner

*Primary Examiner*—Raleigh W. Chiu

(57) ABSTRACT

A coin dropping game system has a lower base with a horizontal lower plate, an open top and vertical side walls. An upper base has a horizontal lower plate, an open top and vertical side walls. The lower plate of the upper base is centrally positioned upon the open top of the lower base. An exterior housing is fabricated of a plastic material with an open upper end, an open bottom end coupled to the top of the upper base, and a transparent side wall. A lid is positioned over the upper end of the exterior housing in contact with the upper end of the interior housing. A central aperture and a plurality of slots are provided through the lid. A vertical support shaft has a lower end rotatably coupled with respect to the upper base and an upper end extending upwardly through the central aperture in the lid. A handle on the upper end of the vertical support shaft is provided for being turned by a player. The support shaft has axially spaced horizontal plates. Each of the plates is formed with a plurality of generally pie-shaped planar coin-receiving surfaces.

8 Claims, 4 Drawing Sheets

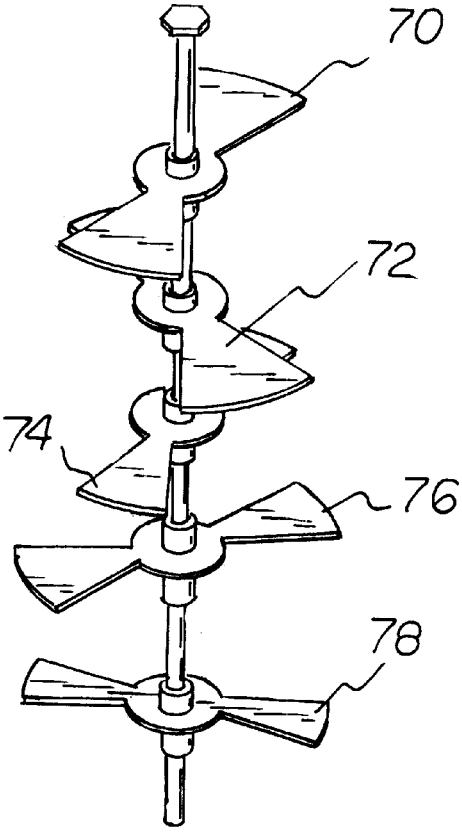
FIG 5
FIG 6
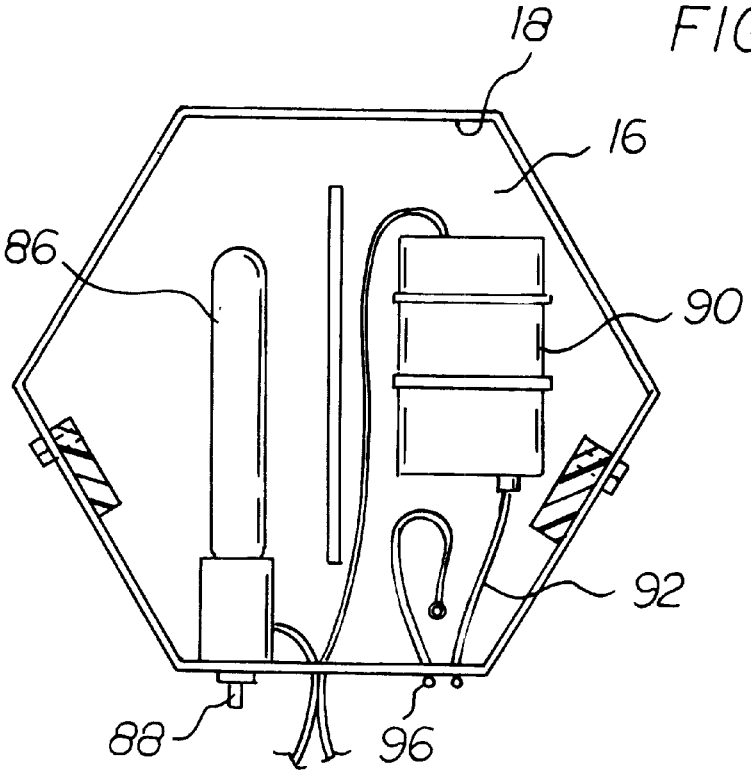

COIN DROPPING GAME SYSTEM

BACKGROUND OF THE INVENTION

1. Field of the Invention

The present invention relates to a coin dropping game system and more particularly pertains to testing the manual dexterity of a player dropping a coin while turning a coin-receiving surface.

2. Description of the Prior Art

The use of games of known designs and configurations wherein coins are dropped or tossed is known in the prior art. More specifically, games of known designs and configurations wherein coins are dropped or tossed previously devised and utilized for the purpose of determining the manual dexterity of a game player through known methods and apparatuses are known to consist a basically of familiar, expected, and obvious structural configurations, notwithstanding the myriad of designs encompassed by the crowded prior art which has been developed for the fulfillment of countless objectives and requirements.

By way of example, U.S. Pat. No. 5,282,636 to Wyman et al. discloses a novelty game. U.S. Pat. No. 4,177,986 to Campbell discloses a coin drop game. Lastly, U.S. Pat. No. 4,418,912 to Tottey discloses an amusement device.

While these devices fulfill their respective, particular objectives and requirements, the aforementioned patents do not describe a coin dropping game system that allows testing the manual dexterity of a player dropping a coin while turning a coin-receiving surface.

In this respect, the coin dropping game system according to the present invention substantially departs from the conventional concepts and designs of the prior art, and in doing so provides an apparatus primarily developed for the purpose of testing the manual dexterity of a player dropping a coin while turning a coin-receiving surface.

Therefore, it can be appreciated that there exists a continuing need for a new and improved coin dropping game system which can be used for testing the manual dexterity of a player dropping a coin while turning a coin-receiving surface. In this regard, the present invention substantially fulfills this need.

SUMMARY OF THE INVENTION

In view of the foregoing disadvantages inherent in the known types of games of known designs and configurations wherein coins are dropped or tossed now present in the prior art, the present invention provides an improved coin dropping game system. As such, the general purpose of the present invention, which will be described subsequently in greater detail, is to provide a new and improved coin dropping game system and method which has all the advantages of the prior art and none of the disadvantages.

To attain this, the present invention essentially comprises a system including a lower base of an opaque plastic material. The lower base has a horizontal lower plate and an open top. The lower base also has vertical side walls between its lower plate and open top. Elastomeric pads are secured to the lower face of the lower base as shown in the bottom of FIG. 2 in order to abate vibrations. The lower base is formed in a six-sided symmetrical configuration. Next provided is an upper base of an opaque plastic material. The upper base has a horizontal lower plate and an open top. The upper base also has vertical side walls between its lower plate and open top. The upper base is also formed in six-sided symmetrical configuration. The lower plate of the upper base is larger than the open top of the lower base. The lower plate of the upper base is centrally positioned upon the open top of the lower base. An exterior housing is next provided. The exterior housing is fabricated of a plastic material. The exterior housing has an open upper end. The exterior housing also has an open bottom end coupled to the top of the upper base. The exterior housing also has a transparent side wall between its open upper end and its open bottom end. The exterior housing is also formed in a symmetric six-sided configuration. Next provided is an interior housing. The interior housing is formed in a cylindrical configuration with a circular cross section. The interior housing has an open upper end. The interior housing also has a closed lower end centrally positioned upon the lower plate of the upper base. The closed lower end has a raised central region with a central aperture. An interior chamber within the interior housing and an exterior chamber between the interior housing and exterior housing are thereby formed. The exterior chamber supports a quantity of water. A lid is next provided. The lid is positioned over the upper end of the exterior housing in contact with the upper end of the interior housing. A central aperture and a plurality of slots are provided through the lid. A horizontal slot in the lid receives a projection formed in the exterior housing to secure the coupling there between. A vertical support shaft is next provided. The vertical support shaft has a lower end rotatably coupled with respect to the upper base. The vertical support shaft also has an upper end extending upwardly through the central aperture in the lid to above the interior housing. A handle is provided on the upper end of the support shaft for being turned by a player. The support shaft has five axially spaced horizontal plates. Each of the plates is formed with a plurality of planar coin-receiving surfaces, preferably two surfaces per plate. Note FIG. 5. Each of the coin-receiving surfaces is in a generally pie-shaped configuration. Cutouts are provided between the surfaces. The coin-receiving surface of the upper plate is greater in size than the size of the coin-receiving surfaces of the plates beneath the coin-receiving surface of the upper plate. The plates and coin-receiving surfaces are adapted to be rotated by a player upon the rotation of the upper end of the shaft. Next provided are operational components mounted within a lower base. The operational components include a lamp with a switch extending to the exterior of the lower base. An electrically operated pump is included as one of the operation components. Electrical lines extend from the pump to exterior of the housing for coupling with a source of electrical potential. A tube extends through the pump into the lower extent of the exterior chamber. Apertures in the tube function as a manifold to disseminate bubbles upwardly through water in the exterior chamber. Spaced clips secure the manifold to the upper base. Next provided is a priming line. The priming line has two lower ends coupled to the pump and to the manifold. A raised intermediate extent is secured to the exterior housing adjacent to its upper end by a clip. Coupling components are provided between the upper base and the interior housing. The coupling components include horizontal plates extending radially outward from the lower portion of the interior housing. Fixed co-operable inverted L-shaped receivers extend upwardly and radially inwardly from the upper base for the coupling and uncoupling of the interior housing from the upper base member upon mutual rotation there between. Next provided are security in components between the lid and the exterior housing. The security components include adjacent holes in the lid and the exterior housing and a padlock for selectively locking and unlocking the lid onto the exterior housing to secure coins within the housings. A vertical sign is provided for supporting indicia relating to the nature of the game and prizes to be won and charities to be helped. The sign includes a horizontal lower extension formed with an aperture and a fastener for removably joining the sign to the upper end of the exterior housing. In this manner when a coin is dropped through one of the slots and the handle is turned by the player, a coin may fall and possibly rest on one of the plates. Upon further movement of the plates, the coin may possibly be moved to rest on one of the lower plates with the score of the player increasing as a function of the lower most plate in which the player may make a coin rest.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved coin dropping game system which has all of the advantages of the prior art games of known designs and configurations wherein coins are dropped or tossed and none of the disadvantages.

It is another object of the present invention to provide a new and improved coin dropping game system which may be easily and efficiently manufactured and marketed.

It is further object of the present invention to provide a new and improved coin dropping game system which is of durable and reliable constructions.

An even further object of the present invention is to provide a new and improved coin dropping game system which is susceptible of a low cost of manufacture with regard to both materials and labor, and which accordingly is then susceptible of low prices of sale to the consuming public, thereby making such coin dropping game system economically available to the buying public.

Even still another object of the present invention is to provide a coin dropping game system for testing the manual dexterity of a player dropping a coin while turning a coin-receiving surface.

Lastly, it is an object of the present invention to provide a new and improved coin dropping game system having a lower base with a horizontal lower plate, an open top and vertical side walls. An upper base has a horizontal lower plate, an open top and vertical side walls. The lower plate of the upper base is centrally positioned upon the open top of the lower base. An exterior housing is fabricated of a plastic material with an open upper end, an open bottom end coupled to the top of the upper base, and a transparent side wall. A lid is positioned over the upper end of the exterior housing in contact with the upper end of the interior housing. A central aperture and a plurality of slots are provided through the lid. A vertical support shaft has a lower end rotatably coupled with respect to the upper base and an upper end extending upwardly through the central aperture in the lid. A handle on the upper end of the vertical support shaft is provided for being turned by a player. The support shaft has axially spaced horizontal plates. Each of the plates is formed with a plurality of generally pie-shaped planar coin-receiving surfaces.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a perspective showing of the shaft and its handle and its coin-receiving plates.

FIG. 6 is a cross sectional view taken along line 6—6 of FIG. 2.

The same reference numerals refer to the same parts throughout the various Figures.

DESCRIPTION OF THE PREFERRED EMBODIMENT

Figure 1:
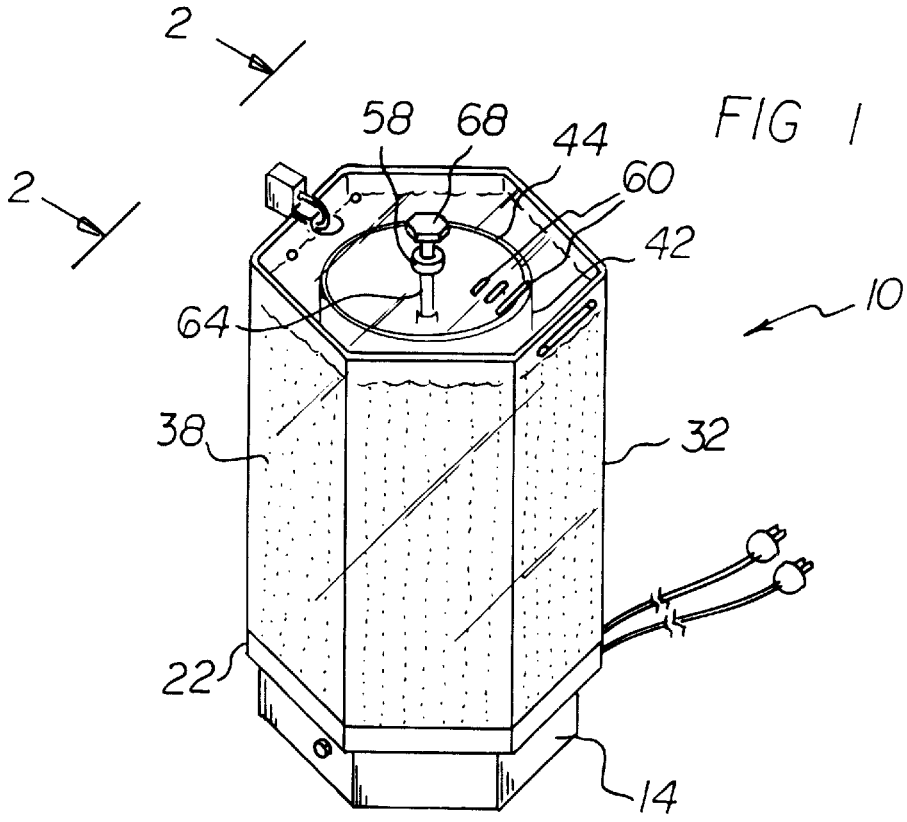
FIG. 1 is a perspective illustration of the coin dropping game system constructed in accordance with the principles of the present invention.

With reference now to the drawings, and in particular to FIG. 1 thereof, the preferred embodiment of the new and improved coin dropping game system embodying the principles and concepts of the present invention and generally designated by the reference numeral 10 will be described.

The present invention, the coin dropping game system 10 is comprised of a plurality of components. Such components in their broadest context include a lower base, an upper base, an exterior housing, a lid, and a vertical support shaft. Such components are individually configured and correlated with respect to each other so as to attain the desired objective.

Figure 2:
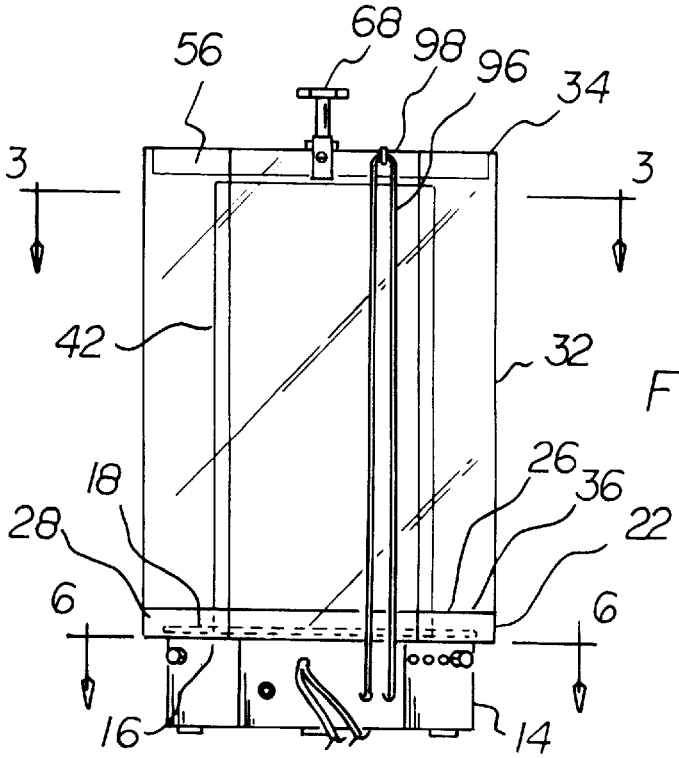
FIG. 2 is a side elevational view taken along line 2—2 of FIG. 1.
Figure 3:
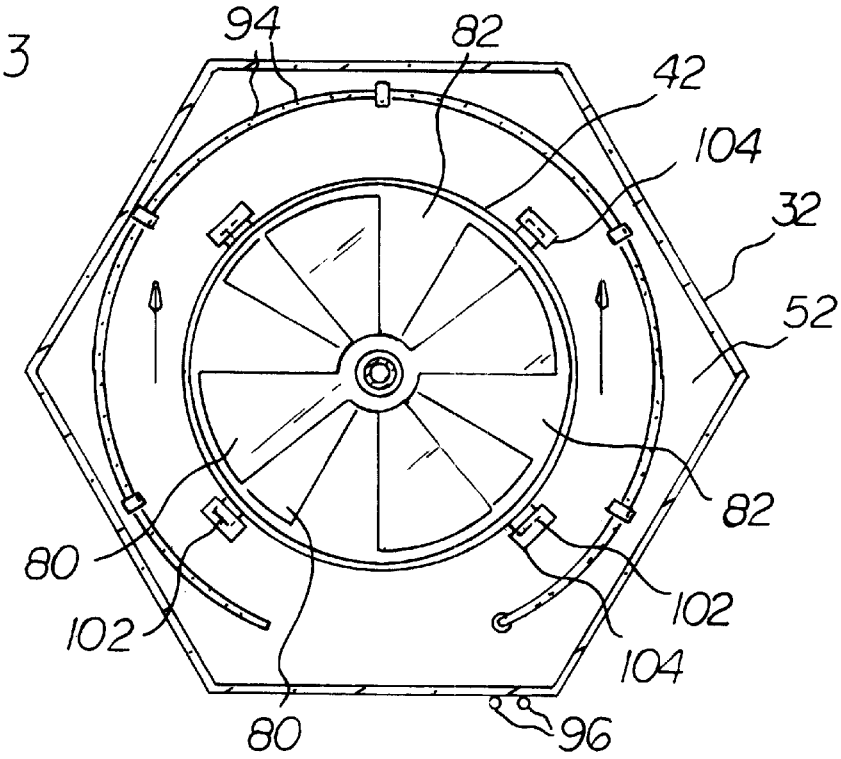
FIG. 3 is a cross sectional view taken along line 3—3 of FIG. 2.
Figure 4:
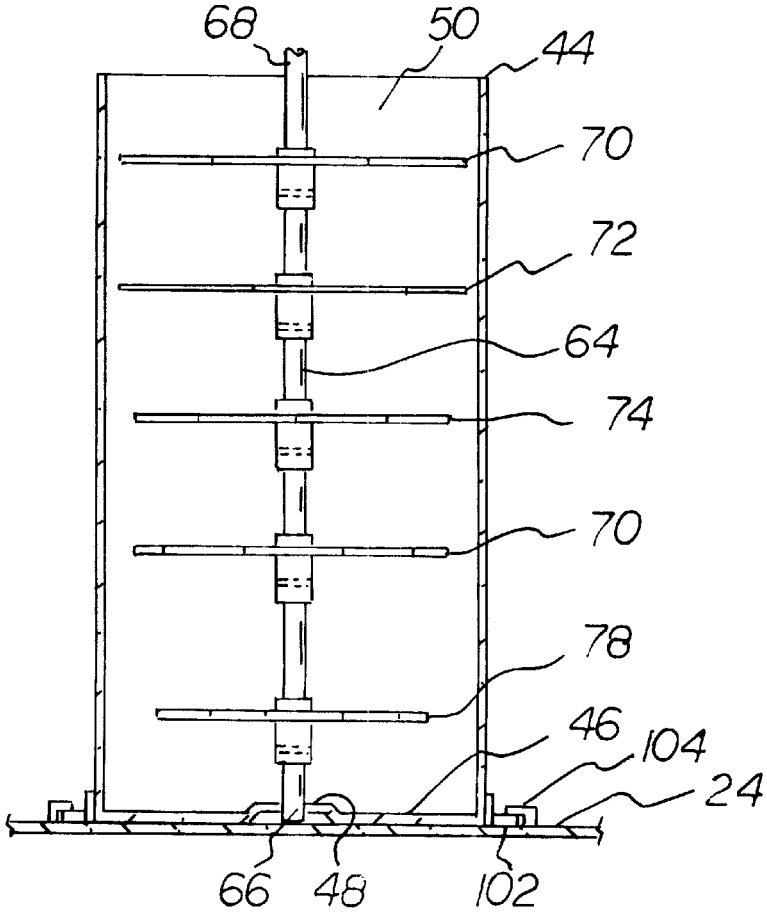
FIG. 4 is a front elevational view of the upper components shown in FIGS. 1 and 2 with parts broken awauy to show certain internal construction.

First provided is a lower base 14 of an opaque plastic material. The lower base has a horizontal lower plate 16 and an open top 18. Elastomeric pads are secured to the lower face of the lower base as shown in the bottom of FIG. 2 in order to abate vibrations. The lower base also has vertical side walls 20 between its lower plate and open top. The lower base is formed in a six-sided symmetrical configuration.

Next provided is an upper base 22 of an opaque plastic material. The upper base has a horizontal lower plate 24 and an open top 26. The upper base also has vertical side walls 28 between its lower plate and open top. The upper base is also formed in six-sided symmetrical configuration. The lower plate of the upper base is larger than the open top of the lower base. The lower plate of the upper base is centrally positioned upon the open top of the lower base.

An exterior housing 32 is next provided. The exterior housing is fabricated of a plastic material. The exterior housing has an open upper end 34. The exterior housing also has an open bottom end 36 coupled to the top of the upper base. The exterior housing also has a transparent side wall 38 between its open upper end and its open bottom end. The exterior housing is also formed in a symmetric six-sided configuration.

Next provided is an interior housing 42. The interior housing is formed in a cylindrical configuration with a circular cross section. The interior housing has an open upper end 44. The interior housing also has a closed lower end 46 centrally positioned upon the lower plate of the upper base. The closed lower end has a raised central region with a central aperture 48. An interior chamber 50 within the interior housing and an exterior chamber 52 between the interior housing and exterior housing are thereby formed. The exterior chamber supports a quantity of water.

A lid 56 is next provided. The lid is positioned over the upper end of the exterior housing in contact with the upper end of the interior housing. A central aperture 58 and a plurality of slots 60 are provided through the lid. A horizontal slot in the lid receives a projection formed in the exterior housing to secure the coupling there between.

A vertical support shaft 64 is next provided. The vertical support shaft has a lower end 66 received within the central aperture of the interior housing. The vertical support shaft also has an upper end extending upwardly through the central aperture in the lid to above the interior housing. A handle 68 is provided on the upper end of the support shaft for being turned by a player. The support shaft has five axially spaced horizontal plates 70, 72, 74, 76, 78. Each of the plates is formed with a plurality of planar coin-receiving surfaces 80, preferably two surfaces per plate. Not FIG. 5. Each of the coin-receiving surfaces is in a generally pie-shaped configuration. Cutouts 82 are provided between the surfaces. The coin-receiving surface of the upper plate is greater in size than the size of the coin-receiving surfaces of the plates beneath the coin-receiving surface of the upper plate. The plates and coin-receiving surfaces are adapted to be rotated by a player upon the rotation of the upper end of the shaft.

Next provided are operational components mounted within a lower base. The operational components include a lamp 86 with a switch 88 extending to the exterior of the lower base. An electrically operated pump 90 is included as one of the operation components. Electrical lines extend from the pump to exterior of the housing for coupling with a source of electrical potential. A tube 92 extends through the pump into the lower extent of the exterior chamber. Apertures 94 in the tube function as a manifold to disseminate bubbles upwardly through water in the exterior chamber. Spaced clips secure the manifold to the upper base.

Next provided is a priming line 96. The priming line has two lower ends coupled to the pump and to the manifold. A raised intermediate extent 98 is secured to the exterior housing adjacent to its upper end by a clip.

Coupling components are provided between the upper base and the interior housing. The coupling components include horizontal plates 102 extending radially outward from the lower portion of the interior housing. Fixed co-operable inverted L-shaped receivers 104 extend upwardly and radially inwardly from the upper base for the coupling and uncoupling of the interior housing from the upper base member upon mutual rotation there between.

Next provided are security components between the lid and the exterior housing. The security components include adjacent holes 108, 110 in the lid and the exterior housing and a padlock 112 for selectively locking and unlocking the lid onto the exterior housing to secure coins within the housings.

A vertical sign 116 is provided for supporting indicia relating to the nature of the game and prizes to be won and charities to be helped. The sign includes a horizontal lower extension 118 formed with an aperture 120 and a fastener 122 for removably joining the sign to the upper end of the exterior housing. In this manner when a coin is dropped through one of the slots and the handle is turned by the player, a coin may fall and possibly rest on one of the plates. Upon further movement of the plates, the coin may possibly be moved to rest on one of the lower plates with the score of the player increasing as a function of the lower most plate in which the player may make a coin rest.

Figure 7:
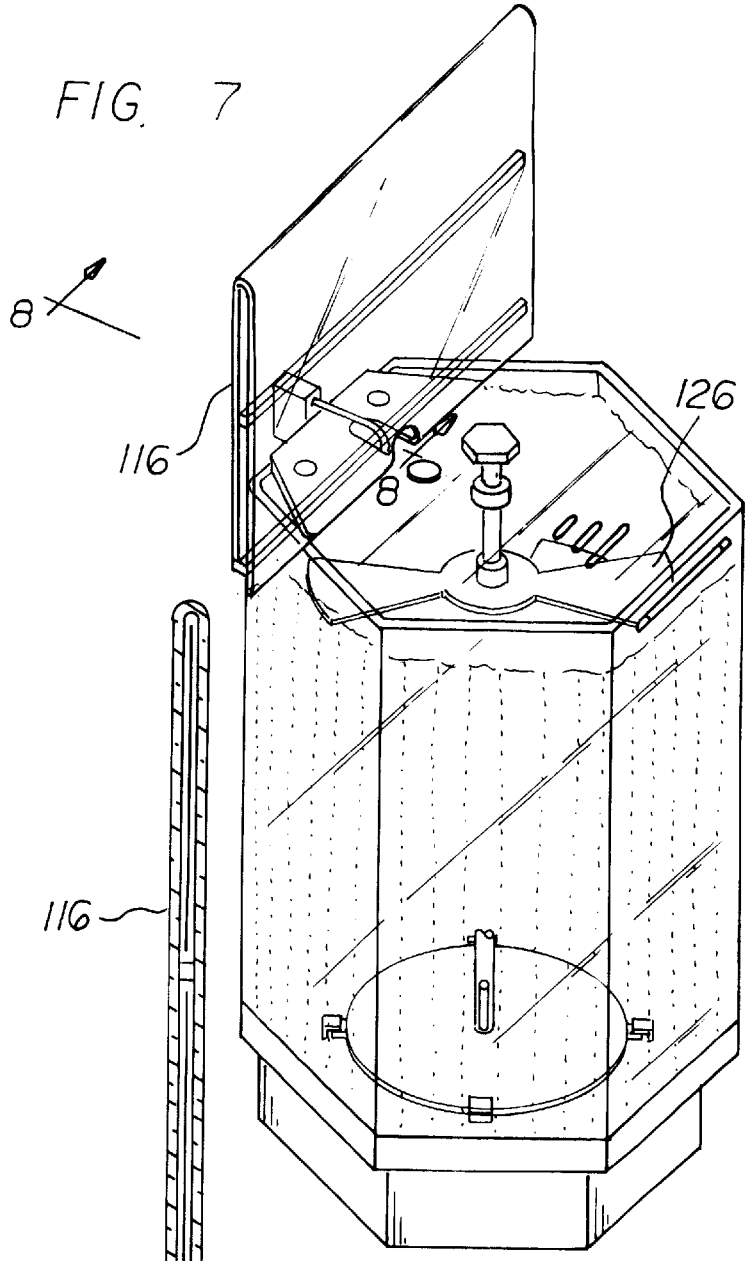
FIG. 7 is a perspective illustration of an alternate embodiment of the invention.
Figure 8:
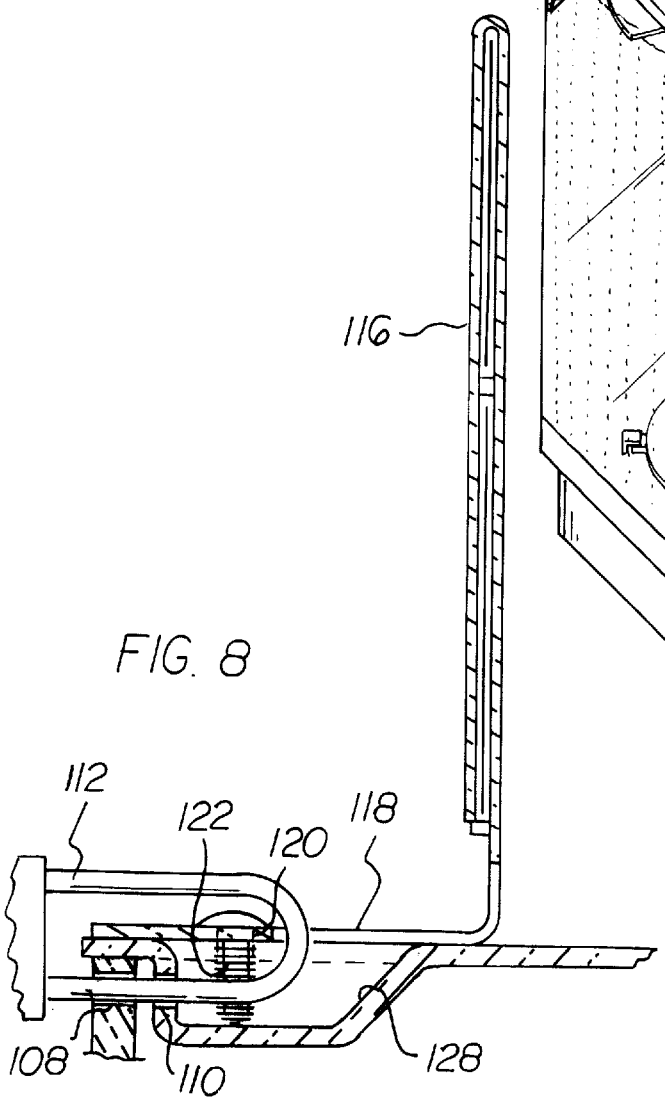
FIG. 8 is a cross-sectional view taken along line 8—8 of FIG. 7.

An alternate embodiment of the invention is shown in FIGS. 7 and 8. In such embodiment, the interior housing is eliminated. As such, water fills the entire space within the exterior housing unlike the primary embodiment wherein the water is only between the two housings. The shaft is hollow with its lower end rotatably received upon a vertical post extending upwardly from a removable plate formed with radial projections positionable beneath the receivers 104. This arrangement allows the horizontal plates 126 to have a greater radial length. In the primary embodiment, dropped coins falls through air while in the alternate embodiment, dropped coins fall through water. Further, the sign and its coupling to the lid by an inverted plastic Christmas tree shaped fastener may be readily utilized in either or both embodiments. When the sign is utilized, the lid must be formed with a recess 128 to accommodate a leg of the padlock.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A coin dropping game system for testing the manual dexterity of a player dropping a coin and turning a coin receiving surface comprising, in combination:

a lower base of an opaque plastic material having a horizontal lower plate and an open top and vertical side walls there between, the lower base having a six-sided symmetrical configuration;

an upper base of an opaque plastic material having a horizontal lower plate and an open top and vertical side walls there between, the upper base having a six-sided symmetrical configuration, the lower plate of the upper base being larger than the open top of the lower base and centrally positioned upon the open top of the lower base;

an exterior housing fabricated of a plastic material with an open upper end and an open bottom end coupled to the top of the upper base and a transparent side wall there between, the exterior housing having a symmetric six-sided configuration;

an interior housing in a cylindrical configuration with a circular cross section with an open upper end and a closed lower end centrally positioned upon the lower plate of the upper base with the closed lower end having a raised central region with a central aperture to thereby form an interior chamber within the interior housing and an exterior chamber between the interior housing and exterior housing, the exterior chamber supporting a quantity of water;

a lid positioned over the upper end of the exterior housing in contact with the upper end of the interior housing with a central aperture in the lid and with a plurality of slots through the lid;

a vertical support shaft having a lower end received within the central aperture of the interior housing and having an upper end extending upwardly through the central aperture in the lid to above the interior housing with a handle thereon for being turned by a player, the support shaft having five axially spaced horizontal plates with each of the plates being formed with a plurality of planar coin-receiving surfaces, each in a generally pie-shaped configuration and with cutouts between the surfaces, the coin-receiving surface of the upper plate being greater in size than the size of the coin-receiving surfaces of the plates there beneath, the plates and coin-receiving surfaces adapted to be rotated by a player upon the rotation of the upper end of the shaft;

operational components mounted within a lower base including a lamp with a switch extending to the exterior of the lower base with an electrically operated pump with a electrical lines extending from the pump to exterior of the housing for coupling with a source of electrical potential, the pump having a tube extending there through into the lower extent of the exterior chamber with apertures therein for functioning as a manifold to disseminate bubbles upwardly through water in the exterior chamber;

a priming line having two lower ends coupled to the pump and to the manifold with a raised intermediate extent secured to the exterior housing adjacent to its upper end;

coupling components between the upper base and the interior housing including horizontal plates extending radially outward from the lower portion of the interior housing and fixed co-operable inverted L-shaped receives extending upwardly and radially inwardly from the upper base for the coupling and uncoupling of the interior housing from the upper base member upon mutual rotation there between; security components between the lid and the exterior housing including adjacent holes in the lid and the exterior housing with a padlock for selectively locking and unlocking the lid onto the exterior housing to secure coins within the housings;

a vertical sign for supporting indicia relating to the nature of the game and prizes to be won and charities to be helped, the sign including a horizontal lower extension formed with an aperture and a fastener for removably joining the sign to the upper end of the exterior housing whereby when a coin is dropped through one of the slots and the handle is turned by the player, a coin may fall and possibly rest on one of the plates and then upon further movement of the plates, the coin may possibly be moved to rest on one of the lower plates with the score of the player increasing as a function of the lower most plate in which the player may make a coin rest.

2. A coin dropping game system comprising:

a lower base having a horizontal lower plate and an open top and vertical side walls there between;

an upper base having a horizontal lower plate and an open top and vertical side walls there between, the lower plate of the upper base being centrally positioned upon the open top of the lower base;

an exterior housing fabricated of a plastic material with an open upper end and an open bottom end coupled to the top of the upper base and a transparent side wall there between;

a lid positioned over the upper end of the exterior housing in contact with the upper end of the interior housing with a central aperture in the lid and with a plurality of slots through the lid;

a vertical support shaft having a lower end rotatably coupled with respect to the upper base and having an upper end extending upwardly through the central aperture in the lid to above the interior housing with a handle thereon for being turned by a player, the support shaft having axially spaced horizontal plates with each of the plates being formed with a plurality of planar coin-receiving surfaces; and an interior housing in a cylindrical configuration with an open upper end and a closed lower end centrally positioned upon the lower plate of the upper base with the closed lower end having a central region with a central aperture to thereby form an interior chamber within the interior housing and an exterior chamber between the interior housing and exterior housing, the exterior chamber supporting a quantity of fluid.

3. The system as set forth in claim 2 and further including cutouts between the coin-receiving surfaces of the plates, the coin receiving surface of the upper plate being greater in size than the size of the coin-receiving surfaces of the plates there beneath, the plates and coin-receiving surfaces adapted to be rotated by a player upon the rotation of the upper end of the shaft.

4. The system as set forth in claim 2 and further including operational components mounted within a lower base including a lamp with a switch extending to the exterior of the lower base with an electrically operated pump with a electrical lines extending from the pump to exterior of the housing for coupling with a source of electrical potential, the pump having a tube extending there through into the lower extent of the exterior chamber with apertures therein for functioning as a manifold to disseminate bubbles upwardly through water in the exterior chamber.

5. The system as set forth in claim 4 and further including a priming line having two lower ends coupled to the pump and to the manifold with a raised intermediate extent secured to the exterior housing adjacent to its upper end.

6. The system as set forth in claim 2 and further including coupling components between the upper base and the interior housing including horizontal plates extending radially outward from the lower portion of the interior housing and fixed co-operable inverted L-shaped receives extending upwardly and radially inwardly from the upper base for the coupling and uncoupling of the interior housing from the upper base member upon mutual rotation there between.

7. The system as set forth in claim 2 and further including security components between the lid and the exterior housing including adjacent holes in the lid and the exterior housing with a padlock for selectively locking and unlocking the lid onto the exterior housing to secure coins within the housings.

8. The system as set forth in claim 2 and further including a vertical sign for supporting indicia relating to the nature of the game and prizes to be won and charities to be helped, the sign including a horizontal lower extension formed with an aperture and a fastener for removably joining the sign to the upper end of the exterior housing whereby when a coin is dropped through one of the slots and the handle is turned by the player, a coin may fall and possibly rest on one of the plates and then upon further movement of the plates, the coin may possibly be moved to rest on one of the lower plates with the score of the player increasing as a function of the lower most plate in which the player may make a coin rest.

* * * * *